US007197802B2

(12) United States Patent
Kurz et al.

(10) Patent No.: US 7,197,802 B2
(45) Date of Patent: Apr. 3, 2007

(54) CONTROL METHOD FOR A FINISHING TRAIN AND A FINISHING TRAIN

(75) Inventors: Matthias Kurz, Erlangen (DE); Michael Metzger, Erlangen (DE); Klaus Weinzierl, Nürnberg (DE)

(73) Assignee: Siemens Aktiengesellschaft, Munich (DE)

( * ) Notice: Subject to any disclaimer, the term of this patent is extended or adjusted under 35 U.S.C. 154(b) by 372 days.

(21) Appl. No.: 10/839,105

(22) Filed: May 5, 2004

(65) Prior Publication Data

US 2004/0205951 A1 Oct. 21, 2004

Related U.S. Application Data

(63) Continuation of application No. PCT/DE02/04125, filed on Nov. 7, 2002.

(30) Foreign Application Priority Data

Nov. 15, 2001 (DE) ..... 101 56 008

(51) Int. Cl.
*B23Q 17/00* (2006.01)
*B21B 37/74* (2006.01)

(52) U.S. Cl. ..... 29/407.01; 29/407.05; 29/819; 72/6.2; 72/11.3; 72/12.2; 72/18.3; 72/19.1; 72/201

(58) Field of Classification Search ..... 29/404, 29/405, 407.01, 407.05, 407.09, 709, 722, 29/819; 72/6.2, 7.2, 7.6, 8.1, 8.5, 9.2, 11.3, 72/12.2, 12.7, 14.9, 18.3, 19.1, 201, 200, 72/252.5, 365.2, 366.2; 266/87
See application file for complete search history.

(56) References Cited

U.S. PATENT DOCUMENTS 3,779,054 A * 12/1973 Greenberger ..... 72/12.2
4,907,439 A 3/1990 Diel et al. ..... 72/247

(Continued)

FOREIGN PATENT DOCUMENTS

JP A-55158816 12/1980

(Continued)

OTHER PUBLICATIONS

Pär Sixtensson, et al.; "New Process Technologies and automation Systems for Hot Rolling Mills"; International Conf. on New Developments in Metallurgical Process Technology. p. 208-217, 1999.

(Continued)

*Primary Examiner*—Jermie E. Cozart
(74) *Attorney, Agent, or Firm*—Baker Botts L.L.P.

(57) ABSTRACT

According to a method, initial temperatures (T1) of strip points (101) are detected when the hot-rolled strip (6) is fed to the production line. The strip points (101) are monitored on their way through the production line. The hot-rolled strip (6) is subjected to temperature influences (delta T) in the production line (3). The strip points (101), the initial temperatures (T1), the monitored values (W(t)) and the temperature influences (delta T) are supplied to a model (9) for the production line (3). The model (9) determines expected actual temperatures (T2) of the strip points (101) in real time and allocates them to the strip points as the new actual temperatures (T2).

19 Claims, 4 Drawing Sheets

U.S. PATENT DOCUMENTS

| | | | | |
|---|---|---|---|---|
| 6,185,970 | B1 * | 2/2001 | Latzel | 72/201 |
| 6,220,067 | B1 | 4/2001 | Sano | 72/8.5 |
| 6,225,609 | B1 | 5/2001 | Imanari et al. | 219/494 |
| 6,866,729 | B2 * | 3/2005 | Gramckow et al. | 148/511 |
| 2003/0089431 | A1 | 5/2003 | Gramckow et al. | 148/511 |

FOREIGN PATENT DOCUMENTS

| | | |
|---|---|---|
| JP | A-63168211 | 7/1988 |
| JP | A-07088522 | 4/1995 |
| JP | 09 029 317 | 2/1997 |
| WO | WO03045599 A1 * | 6/2003 |

OTHER PUBLICATIONS

Josef Andorfer, et al.; Operational experience with VAI-Q Strip: on-line system for controlling hot rolled strip mechanical properties; Aise Steel Technology, p. 43-46, 2000.

J. Andorfer, et al.; "VAIQ-Strip, un nouveau systeme de controle de qualite pour les bandes laminees a chaud"; La Revue de Metallurgie—CIT; pp. 883-892, 1998.

* cited by examiner

CONTROL METHOD FOR A FINISHING TRAIN AND A FINISHING TRAIN

CROSS REFERENCE TO RELATED APPLICATION

This application is a continuation of copending International Application No. PCT/DE02/04125 filed Nov. 7, 2002 which designates the United States, and claims priority to German application no. 101 56 008.7 filed Nov. 15, 2001.

Technical Field of the Invention

The invention relates to a control method for a finishing train, arranged upstream of a cooling section, for rolling hot metal strip.

Description of the Related Art

DE 199 63 186 A1 has disclosed a control method for a cooling section, upstream of which there is a finishing train for rolling hot metal strip. In this control method, when the hot strip enters the cooling section strip points and their initial temperatures are recorded, and desired-temperature curves are individually assigned to the recorded strip points. The strip points, their initial temperatures and their desired-temperature curves are fed to a model for the cooling section. The displacement of the strip points is monitored as they pass through the cooling section. In the cooling section, the hot strip is subjected to temperature influences by means of temperature-influencing devices. The displacement monitorings and the temperature influences are likewise fed to the model. The model determines actual temperatures that are expected in real time for the recorded strip points and assigns these temperatures to the strip points. As a result, the temperature as a function of the strip thickness is available for each strip point at any instant in time. Furthermore, the model uses the desired-temperature curves assigned to the recorded strip points and the expected actual temperatures to determine control values for the temperature-influencing devices and feeds the control values to these devices. The temperature management is used in particular for the controlled setting of materials and microstructural properties of the hot metal strip. In general, the temperature management is carried out in such a manner that a predetermined coil temperature profile from the end of the cooling section is optimally achieved.

Finishing trains such as the finishing trains mentioned in DE 199 63 186 A1 are likewise generally known. They are usually operated in such a manner—controlled by a pass sequence—that at the end of the finishing train predetermined final dimensions and a predetermined final rolling temperature of the metal strip are reached. The rolling also influences the materials properties, in particular the microstructural properties of the hot strip.

In the prior art, one or more setup calculations, which are used for advance calculation of individual strip segments without any direct temporal relationship to events in the cooling section, generally form the basis for finishing train regulation. The strip velocity in the finishing train is varied by means of a PI regulator or other conventional control on the basis of the measured final rolling temperature and a pre-calculated effect of the strip velocity on the final rolling temperature. Cooling between individual stands of the finishing train is subject only to pilot control.

The higher the demands imposed on the hot metal strip become, the more accurately the production conditions, including the temperature profile, have to be adhered to. This is true very particularly of what are known as new materials, such as for example multiphase steels, TRIP steels and the like, since these materials require an accurately defined heat treatment, i.e. predetermining and monitoring of a temperature profile.

SUMMARY OF THE INVENTION

Therefore, it is an object of the present invention to provide a control method which can be realized in a simple way and by means of which it is possible to ensure that a desired temperature profile is maintained even in the upstream finishing train.

The object is achieved by a control method for a finishing train, arranged upstream of a cooling section, for rolling hot metal strip,

- in which at the latest when the hot strip enters the finishing train, strip points and at least their starting temperatures are recorded,
- in which the strip points and, as actual temperatures, the starting temperatures are fed to a model for the finishing train,
- in which the displacement of the strip points as they pass through the finishing train is monitored,
- in which the hot strip is subjected to temperature influences in the finishing train,
- in which the displacement monitorings and the temperature influences are likewise fed to the model,
- in which the model uses the actual temperatures to determine actual temperatures that are expected in real time for the recorded strip points and assigns these temperatures to the recorded strip points as new actual temperatures.

The variable which describes the energy content may alternatively be the temperature or the enthalpy of the hot metal strip.

If after the strip points have left the finishing train, their final temperatures are recorded, the recorded final temperatures are compared with expected final temperatures determined on the basis of the model, and at least one correction factor for the model is determined on the basis of the comparison, it is easy for the model to be adapted to the actual behavior of the finishing train.

If the recorded strip points are assigned desired values for a variable which describes the energy content and these desired values are fed to the model, in addition to the expected actual temperatures, the model also determines functional relationships between the expected actual temperatures and the correction factor, and in that the expected actual temperatures of the strip points which have already been recorded are corrected on the basis of the correction factor, the expected actual temperatures of the strip points which have already been recorded can easily be corrected, in particular without further model calculations.

If the model uses the desired values assigned to the recorded strip points and the expected actual temperatures to determine control values for temperature-influencing devices, by means of which the actual temperature of the hot strip can be influenced without deformation, and the control values are fed to the temperature-influencing devices, targeted temperature management of the hot strip is also possible.

If at least one of the control values is compared with a desired control value, and if a correction value for a strip velocity of the hot strip is determined on the basis of the comparison, it is easily possible to set the control value in such a manner that the corresponding temperature-influencing device is operated in a middle final control range. As a result, it is in particular readily possible to compensate for temperature fluctuations which occur for brief periods of time by means of the temperature-influencing device.

In one possible configuration of the control method, exclusively a change in a rolling velocity is used to regulate the deformation-free temperature influencing within the finishing train.

The control values may, for example, be determined in such a manner that the deviation of the actual temperatures expected for the strip points from a predetermined location temperature at least one location of the finishing train is minimized. In some cases, this allows the materials properties of the hot strip to be set in a simpler way. This is true in particular if the location is between two rolling stands of the finishing train, and a phase transformation takes place in the hot strip at the location temperature. By means of the control method according to the invention, it is in this case possible to ensure this even if there is no recording of the actual temperature of the hot strip at the location.

The desired values may be identical for all the strip points. However, it is preferable for them to be individually assigned to the strip points.

The desired values may be just individual values which are to be aimed for at specific positions or at specific times, i.e. may be position or time-specific. However, it is preferable for them to form a desired-value curve.

If the model is also used to determine phase components of the respective strip points, even better modeling of the behavior of the hot strip is possible.

If the control method is carried out cyclically, it can be realized in a particularly simple way. The cycle is in this case generally between 0.1 and 0.5 s, typically between 0.2 and 0.3 s.

The control concept according to the invention can be expanded if required. In particular, it is possible for it also to be used to control at least one installation arranged upstream or downstream of the finishing train, e.g. a roughing train, a furnace, a continuous casting installation or a cooling section. This means that in practice it is possible to realize a single, continuous, joint control method from production of the slab or heating of the slab through to coiling of the rolled hot strip. It is also possible for the model to be designed to cover more than just the finishing train.

BRIEF DESCRIPTION OF THE DRAWINGS

Further advantages and details will emerge from the following description of an exemplary embodiment in conjunction with the drawings, in which, in outline form.

DETAILED DESCRIPTION OF THE PREFERRED EMBODIMENTS

Figure 1:
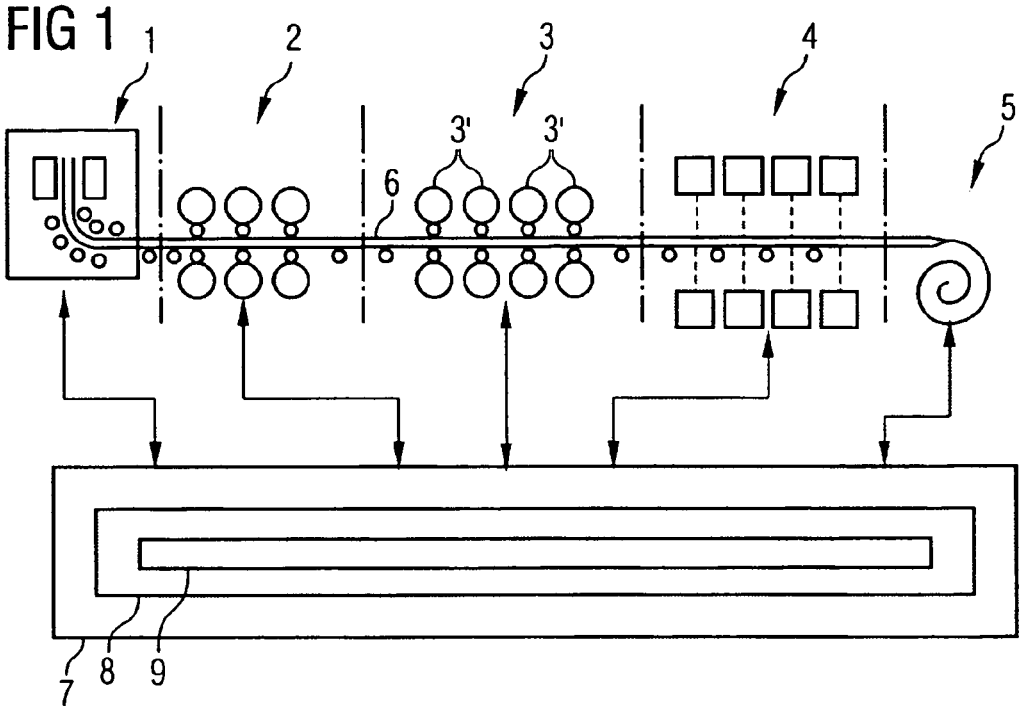
FIG. 1 shows an installation for producing hot metal strip.

In accordance with FIG. 1, an installation for producing hot steel strip 6 comprises a continuous casting installation 1, a roughing train 2, a finishing train 3 and a cooling section 4. Downstream of the cooling section 4 there is a coiler 5, which is used to coil the hot strip 6 which has been produced by the continuous casting installation 1, rolled in the trains 2,3 and cooled in the cooling section 4.

The entire installation is controlled by means of a single control method, which is carried out by a real-time calculation device 7. For this purpose, the real-time calculation device 7 is connected in terms of control technology to the individual components 1 to 5 of the installation for producing hot steel strip 6. Furthermore, it is programmed with a control program 8, on the basis of which it carries out the control method.

The control program 8 includes, inter alia, a—preferably common—physical model 9. This is therefore implemented in the real-time calculation device 7. The real-time calculation device 7 may have one computer or a plurality of computers, in particular process computers. The common model 9 is used to model at least the behavior of the finishing train 3 and of the cooling section 4, and preferably also the behavior of the roughing train 2 and of the continuous casting installation 1.

Figure 2:
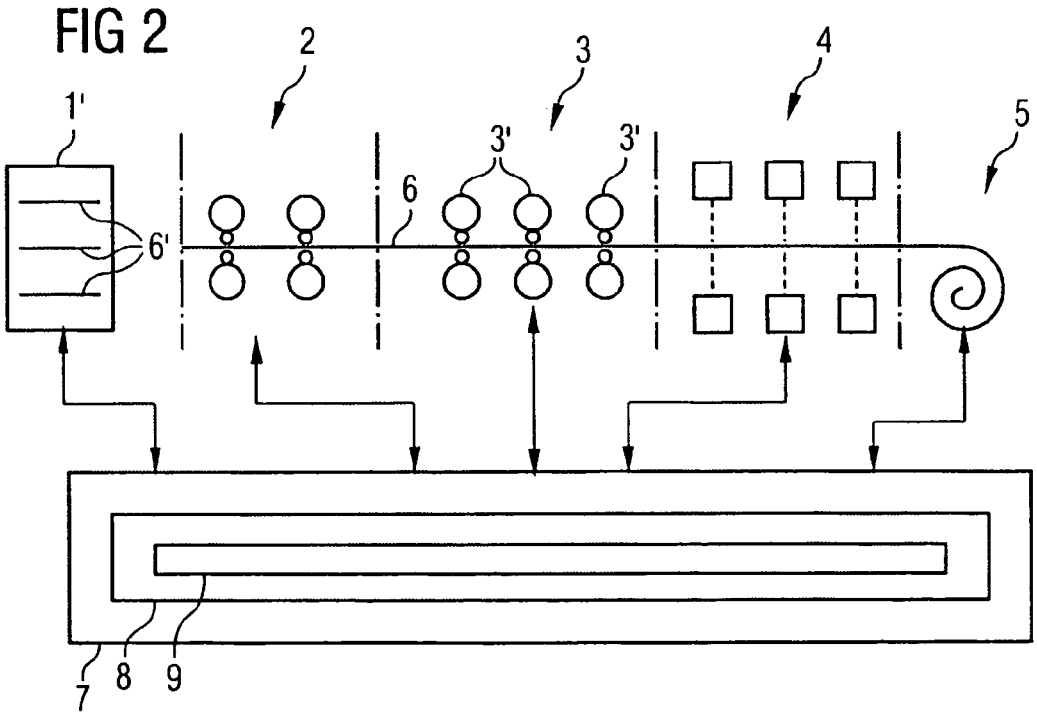
FIG. 2 shows a further installation for producing hot metal strip.

FIG. 2 shows a similar installation to FIG. 1. However, unlike in FIG. 1, it is not the continuous casting installation 1 which is arranged upstream of the roughing train 2, but rather a furnace 1', in which slabs 6' which are to be rolled are heated in advance. In the installation shown in FIG. 2, however, there is likewise continuous control realized by the real-time calculation device 7.

In accordance with FIGS. 1 and 2, the finishing train 3 has a plurality of roll stands 3'. However, this is not necessary. In some cases, the finishing train 3 may also have just a single roll stand 3'. This is true in particular if the continuous casting installation 1 shown in FIG. 1 is already responsible for near net shape casting, i.e. if the hot strip 6 can be rolled to its final dimension in a single pass.

Figure 3:
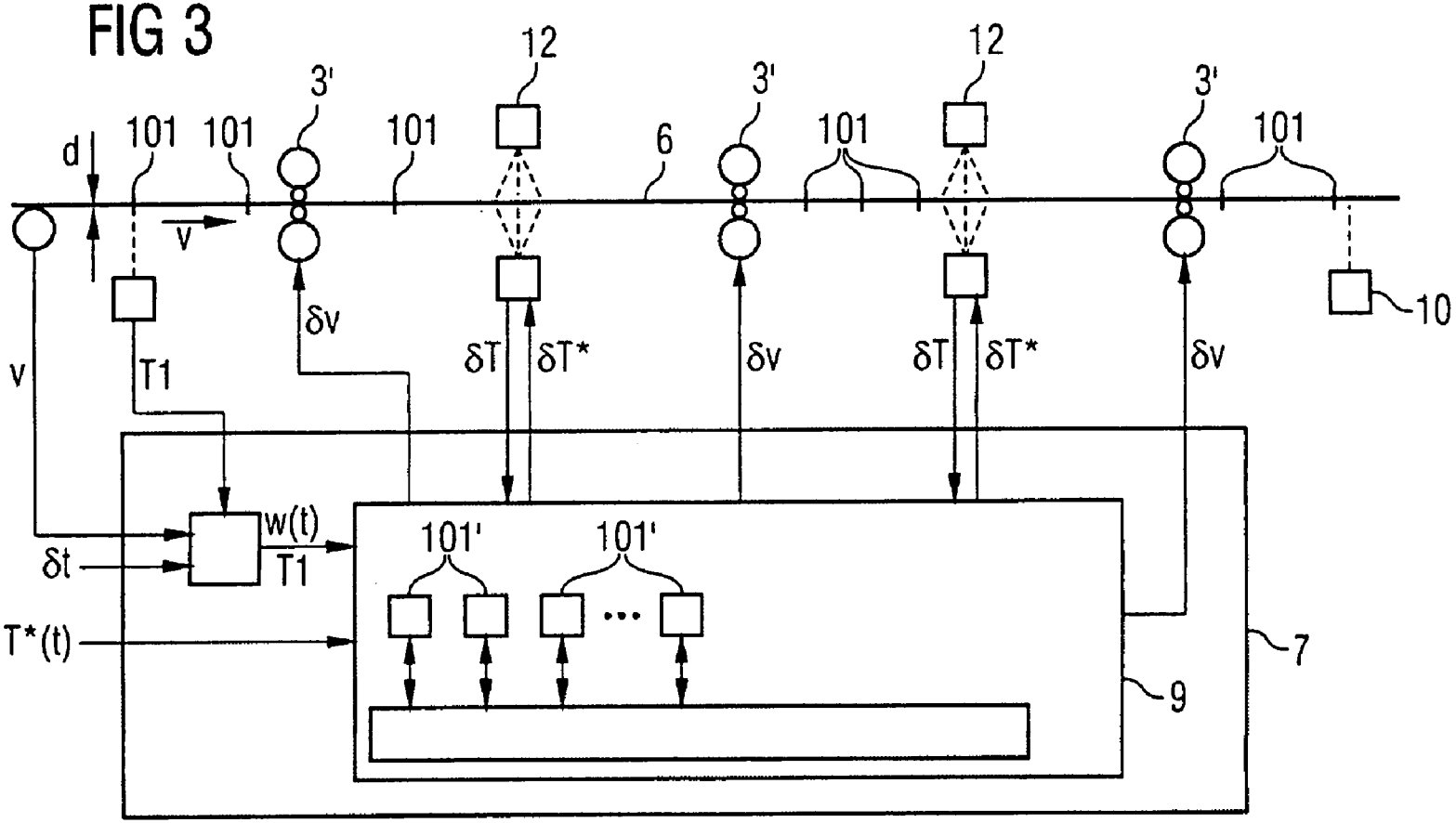
FIG. 3 shows a finishing train.
Figure 4:
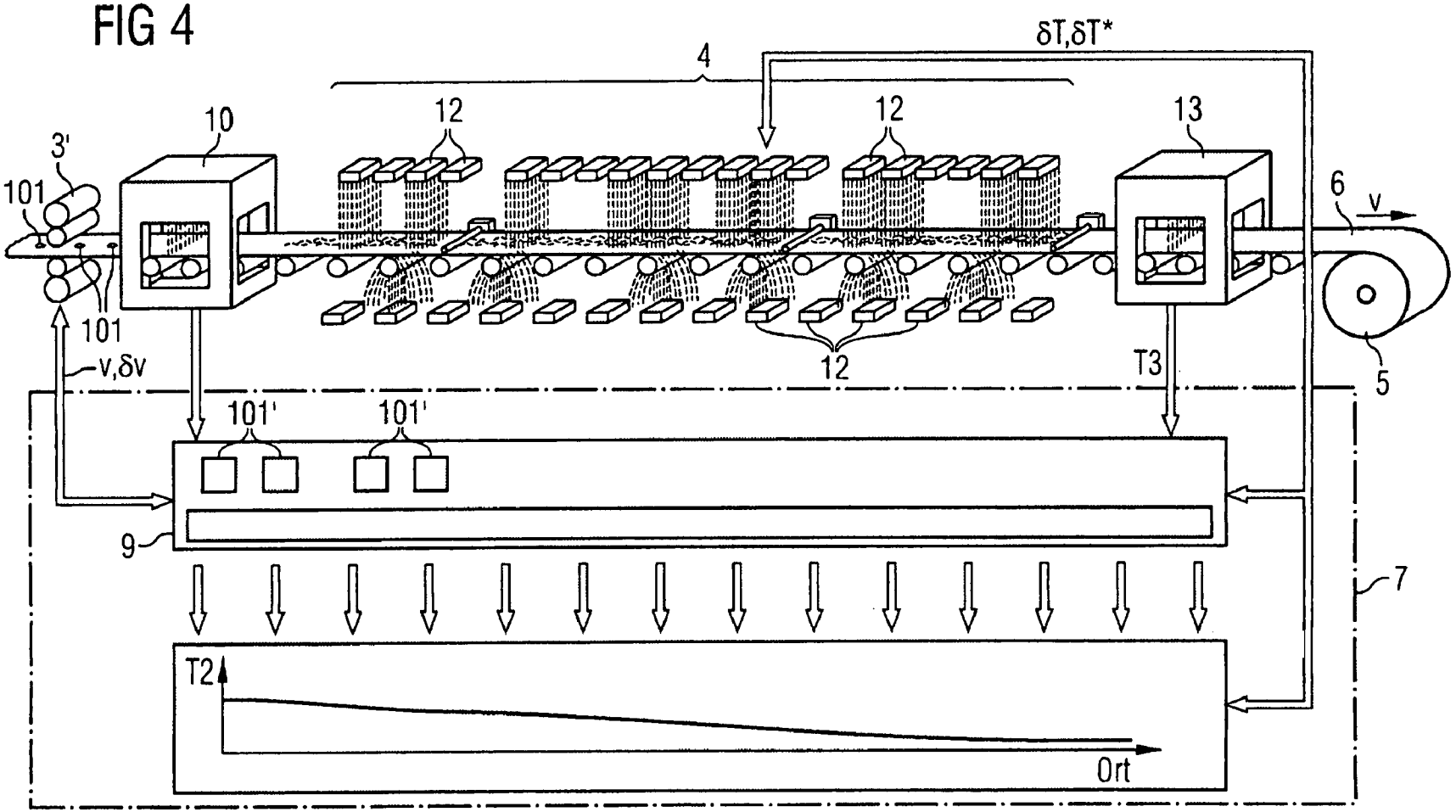
FIG. 4 shows a cooling section.

FIGS. 3 and 4 diagrammatically depict the common control method for the finishing train 3 and the cooling section 4. The division into two figures is made purely for the sake of clarity.

In particular the model 9 is common to (at least) the finishing train 3 and the cooling section 4. Also, an intermediate temperature-measuring station 10, which in accordance with FIG. 3 is arranged at the exit-side end of the finishing train 3, is identical to the temperature-measuring station 10 at the entry to the cooling section 4 shown in FIG. 4. For this reason, the temperature-measuring station in FIG. 4 is also provided with the same reference numeral as in FIG. 3.

In according with FIG. 3, when the hot strip 6 enters the finishing train 3, a starting temperature-measuring station 11, at time cycle $\delta t$, in each case records a strip point 101 and at least its starting temperature T1 and assigns them to corresponding model points 101'. If appropriate, it is also possible to record further variables, such as for example a strip thickness d, and to feed these variables to the model 9. The time cycle $\delta t$ is generally between 0.1 and 0.5 s, and is typically from 0.2 to 0.3 s. On account of the cyclical recording of the strip points 101 and their starting temperatures T1, the overall control method is also carried out cyclically.

The strip points 101 and their starting temperatures T1 are fed to the common model 9. The starting temperatures T1 in this case within the model 9 initially define actual temperatures T2. Furthermore, the strip points 101 are individually assigned desired values T* for a variable which describes the energy content, and these desired values are likewise fed to the model 9. The desired values T* for a variable which describes the energy content may, for example, be temporal desired temperature curves T*(t).

Finally, a starting rolling velocity v and—explicitly or implicitly—pass reductions effected by the individual stands 3' of the finishing train 3 are also fed to the real-time calculation device 7.

The velocity after the respective downstream stands 3' and in the cooling section 4 can be determined from the starting rolling velocity v on the basis of the pass reductions and the known installation configuration. Therefore, displacement monitoring of the strip points 101 as they pass through the finishing train 3 and the cooling section 4 is also possible. The displacement monitoring W(t) which can be calculated in this way is likewise fed to the model 9, where it is assigned to the corresponding model points 101'.

During the time cycle δt between the recording of two strip points 101, the model 9 determines actual temperatures T2 that are expected in real time for the recorded strip points 101, i.e. for all the strip points 101 which at this instant are within the finishing train 3 or the cooling section 4. The determined actual temperatures T2 are assigned to the corresponding model points 101' as new actual temperatures T2. This can be seen particularly clearly from FIG. 5, according to which the expected actual temperatures T2 are fed back to the model 9 as input variables.

Therefore, each time cycle δt generates a new model point 101', which is assigned the actual temperature T1 instantaneously recorded at the starting temperature-measuring station 11 as actual temperature T2. During the time cycle δt, the displacement of the model point 101' through the finishing train 3 and the cooling section 4 is monitored. Its expected actual temperature T2 is updated by the model 9. When the corresponding strip point 101 reaches the measurement stations 10, 13, it is possible to check and correct the model 9.

When the corresponding strip point 101 leaves the cooling section 4, the model point 101' is deleted. Furthermore, the model 9 additionally determines functional relationships f(k) between the (new) actual temperatures T2 and a correction factor k.

The hot strip 6 is subjected to temperature influences δT in the finishing train 3 and the cooling section 4. By way of example, it is possible to use temperature-influencing devices 12 to apply a liquid or gaseous cooling medium (e.g. water or air) to the hot strip 6. The temperature influences δT are likewise fed to the model 9 and are of course taken into account when determining the actual temperatures T2. As can be seen from FIG. 3, cooling devices 12 are also arranged between rolling stands 3'.

A further possible way of influencing the temperature of the hot strip 6 without deformation is to use the rolling velocity v. This too is fed to the model 9.

Finally, the hot strip 6 is also heated as a result of the rolling in the rolling stands 3' per se. Characteristic variables in this respect—e.g. the power consumption of the rolling stands 3' and the temperature of their working rolls—are also fed to the model 9.

The determination of the expected actual temperature T2 is carried out in the model 9 by solving a one-dimensional, non-steady-state heat conduction equation. Therefore, the starting point for the mathematical description is the heat conduction equation for an insulated bar which exchanges heat with the environment only at the start and end, corresponding to the top side and the underside of the hot strip 6. It is therefore assumed that the heat conduction in the strip is zero or negligible in the longitudinal and transverse directions. Any person skilled in the art will be familiar with this solution approach and also its solutions. Therefore, the (expected) actual temperature T2 as a function of the strip thickness is available for any strip point 101 at any instant.

Figure 5:
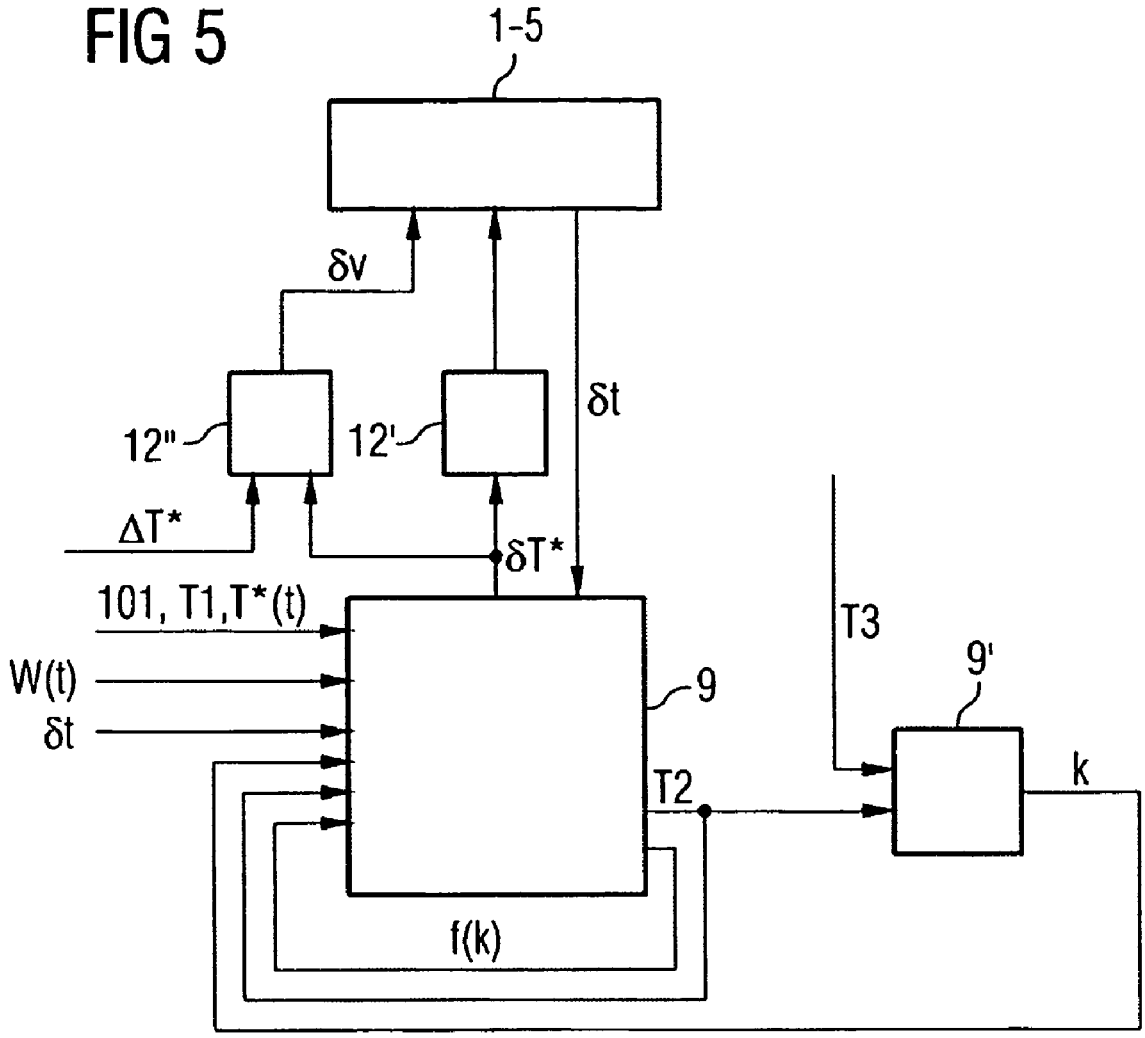
FIG. 5 shows a block diagram of a model.

Then, the model 9 uses the desired values T* for the strip points 101 and their expected actual temperatures T2 to determine the control values δT* for the temperature-influencing devices 12. The control values δT* are fed to the temperature-influencing devices 12 via lower-order regulators 12', as shown in FIG. 5. The regulators 12' are generally designed as predictive regulators in particular if a defined final temperature of the hot strip 6 is to be set at the end of the cooling section 4.

If appropriate, it is also possible for the starting temperatures T1 to be recorded earlier, e.g. on entry into the roughing train 2. In this case, of course, the determination of the expected actual temperatures T2 has to be performed from this position and from this instant.

The model 9 and the real-time calculation device 7 control the temperature curve until the first recorded strip point 101 reaches a temperature-measuring station 10, 13 which is arranged between the finishing train 3 and the coiler 5. Therefore, the model 9 can only be used to calculate the expected actual temperature T2. It is not possible to check whether the actual temperature T2 which is expected on the basis of the model calculation corresponds to a current strip temperature T3.

However, when the first strip point 101 reaches, for example, the final temperature-measuring station 13, it is possible to record the current actual temperature T3 at this location, i.e. on exiting the cooling section 4 and therefore in particular also after exit from the finishing train 3. A correction factor determining means 9' can compare this final temperature T3 with the final temperature T2 expected for this instant, which has been calculated on the basis of the model 9. Then, the correction factor k for the model 9 can be determined on the basis of the comparison. The determination of the correction factor k is also known to those skilled in the art, for example from the abovementioned DE 199 63 186 A1.

Expected actual temperatures T2 for new strip points 101 to be recorded can therefore be determined immediately on the basis of the correspondingly adapted and corrected model 9. Since, furthermore, the functional relationships f(k) between the expected actual temperatures T2 and the correction factor k have already been determined for the strip points 101 which have already been recorded, it is also possible for the expected actual temperatures T2 for the strip points 101 which have already been recorded to be corrected in a simple way on the basis of the correction factor k.

As has already been mentioned, in the configuration shown in FIGS. 3 and 4, an intermediate temperature-measuring station 10 is also arranged between the finishing train 3 and the cooling section 4. This means that it is possible to record the actual temperature T3 of the hot strip 6 as soon as it reaches the intermediate temperature-measuring station 10. This means that even at this stage it is possible to correct the model 9 as well as the expected actual temperatures T2 which have been calculated hitherto. In general terms, any measurement of the actual temperature T3 can also be used to adapt the model 9 and/or to determine or correct at least one correction factor k for the model 9.

Under certain circumstances, it is even possible, with regard to the model adapting, to effect complete separation between a submodel for the finishing train 3 and a submodel for the cooling section 4. It is also possible to use the actual temperature T3 recorded at the intermediate temperature-measuring station 10 to perform preliminary determination of the correction factor k for any submodel of the cooling section 4. However, this is a secondary priority. The crucial factor is for the calculation of the temperatures T2 for the strip points 101 to be performed while the strip points 101 are still passing through the finishing train 3 and for it to be simple for these temperatures to be passed on to the cooling section 4 as part of the model 9. This makes it particularly simple to realize continuous modeling for the finishing train 3 and the cooling section 4. Furthermore, on the basis of the continuous modeling it is possible in a simple way also to realize a common control method for the finishing train 3 and the cooling section 4, and if appropriate also the further installation parts 1, 1' and/or 2.

The control values δT* which are fed to the temperature-influencing devices 12 are additionally compared with desired control values δT* in a velocity regulator 12". A correction value δv for the final rolling velocity v is determined on the basis of the comparison. This makes it easy to operate the temperature-influencing devices 12 in a middle setting range. Of course, the determination of the correction value δv also takes account of the other production conditions and the installation design, as well as the rolling program which is being run. Therefore, the correction of the rolling velocity v serves to compensate for long-term and global effects, whereas the control values δT* eliminate short-term and local effects. It is even possible to vary exclusively the starting rolling velocity v in order to regulate the deformation-free temperature influencing within the finishing train 3.

The desired values T* are generally predetermined as functions of time t, i.e. as temporal desired-temperature curves T*(t). However, it is also possible for the desired-temperature curves T* to be predetermined as a function of the location. In this case, the cooling of the hot strip 6 is managed by the model 9 and the real-time calculation device 7 in such a manner that the deviation in the expected actual temperatures T2 for the strip points 101 from a predetermined location temperature at at least one location of the cooling section 4 and/or the finishing train 3 is minimized. In general, these are the temperatures at the final temperature-measuring station 13 and at the intermediate temperature-measuring station 10.

It is also possible for the predetermined set values T* not to be locally or temporally continuous curves. It is also possible for set temperatures T* to be predetermined only for certain positions or instants. Also, the temperature does not necessarily have to be the desired variable. As an alternative, the enthalpy could also be used.

However, on account of the continuous calculation also of the expected actual temperature T2 in real time, it is also possible to set certain temperatures at locations at which actual recording of the temperature of the hot strip 6 is not possible or is not carried out for other reasons. On account of the continuous temperature calculation by the model 9 in real time, it is in particular possible to ensure that the hot strip 6 reaches a predetermined limit temperature at a location between two rolling stands 3', e.g. between the penultimate and the final rolling stand 3' of the finishing train 3. The limit temperature may be such that a phase transformation takes place in the hot strip 6 at precisely this limit temperature. In this way, it is possible to achieve what is known as two-phase rolling even without true temperature measurement at this location.

Therefore, the control method according to the invention makes it possible to achieve a flexible and suitable heat treatment for modern steels. In particular, the heat control covers several areas. A predetermined desired-temperature curve T*(t) can be set not just in the cooling section 4 or in the finishing train 3 on its own, but also deliberately so as to cover more than just these individual areas.

In the control method described above, the temperature was used as the variable describing the energy content. However, the calculation can also be performed using the enthalpy. Furthermore, it is also possible for the phase components of the individual strip points 101, i.e. austenite, ferrite, martensite, etc., to be included in the calculation in real time as part of the model 9.

Also, positional or temporal temperature curves do not necessarily have to be predetermined as desired values T*. Predetermination for specific positions and/or times may also suffice.

We claim:

1. A control method for a finishing train, arranged upstream of a cooling section, for rolling hot metal strip, comprising the steps of:

when the hot strip enters the finishing train, recording strip points and at least their starting temperatures, feeding the strip points and, as actual temperatures, the starting temperatures to a model for the finishing train, monitoring the displacement of the strip points as they pass through the finishing train, subjecting the hot strip to temperature influences in the finishing train, feeding the displacement monitorings and the temperature influences likewise to the model, using the actual temperatures fed to the model to determine actual temperatures that are expected in real time for the recorded strip points and assigning these temperatures that are expected in real time to the recorded strip points as new actual temperatures.

2. The control method as claimed in claim 1, wherein after the strip points have left the finishing train, their final temperatures are recorded, in that the recorded final temperatures are compared with expected final temperatures determined on the basis of the model, and in that at least one correction factor for the model is determined on the basis of the comparison.

3. The control method as claimed in claim 2, wherein in addition to the expected actual temperatures, the model also determines functional relationships between the expected actual temperatures and the correction factor, and wherein the expected actual temperatures of the strip points which have already been recorded are corrected on the basis of the correction factor.

4. The control method as claimed in claim 1, wherein the recorded strip points are assigned desired values for a variable which describes the energy content and these desired values are fed to the model, in that the model uses the desired values assigned to the recorded strip points and the actual temperatures to determine control values for temperature-influencing devices, by means of which the actual temperature of the hot strip can be influenced without deformation, and wherein the control values are fed to the temperature-influencing devices.

5. The control method as claimed in claim 4, wherein at least one of the control values is compared with a desired control value, and a correction value for a strip velocity of the hot strip is determined on the basis of the comparison.

6. The control method as claimed in claim 4, wherein exclusively a change in a rolling velocity is used to regulate the deformation-free temperature influencing within the finishing train.

7. The control method as claimed in claim 4, wherein the control values are determined in such a manner that the deviation of the actual temperatures expected for the strip points from a predetermined location temperature at least one location of the finishing train is minimized.

8. The control method as claimed in claim 7, wherein the location is between two rolling stands of the finishing train, and in that a phase transformation takes place in the hot strip at the location temperature.

9. The control method as claimed in claim 7, wherein there is no recording of the actual temperature of the hot strip at the location.

10. The control method as claimed in claim 4, wherein the desired values are individually assigned to the strip points.

11. The control method as claimed in claim 4, wherein the desired values are position-or time-specific.

12. The control method as claimed in claim 4, wherein the desired values form a desired value curve.

13. The control method as claimed in claim 1, wherein the model is also used to determine phase components of the respective strip points.

14. The control method as claimed in claim 1, wherein the method is carried out cyclically.

15. The control method as claimed in claim 1, wherein the method is also used to control at least one installation arranged upstream or downstream of the finishing train.

16. The control method as claimed in claim 15, wherein the installation is selected from one or more installations of the group of a roughing train, a furnace, a continuous casting installation and a cooling section.

17. The control method as claimed in claim 15, wherein the control method for the finishing train and for the installation arranged upstream or downstream of the finishing train are a common control method.

18. The control method as claimed in claim 15, wherein the model is designed to cover more than just the finishing train.

19. A finishing train, arranged upstream of a cooling section, for rolling hot metal strip, having a real-time calculation device, which is connected to the finishing train in terms of control technology and wherein the real time calculation device comprises:

means for recording strip points and at least their starting temperatures, means for feeding the strip points and, as actual temperatures, the starting temperatures to a model for the finishing train, means for monitoring the displacement of the strip points as they pass through the finishing train, means for subjecting the hot strip to temperature influences in the finishing train, means for feeding the displacement monitorings and the temperature influences likewise to the model, and means for using the actual temperatures fed to the model to determine actual temperatures that are expected in real time for the recorded strip points and for assigning these temperatures to the recorded strip points as new actual temperatures that are expected inreal time.

* * * * *